US010245499B2

(12) United States Patent
Tremeau et al.

(10) Patent No.: US 10,245,499 B2
(45) Date of Patent: Apr. 2, 2019

(54) TOURING BINDING TO BE FITTED TO A GLIDING BOARD

(71) Applicant: Salewa Sport AG, Herisau (CH)

(72) Inventors: Guilhem Tremeau, Aschheim (DE); Edwin Lehner, Gilching (DE)

(73) Assignee: Salewa Sport AG, Herisau (CH)

( * ) Notice: Subject to any disclaimer, the term of this patent is extended or adjusted under 35 U.S.C. 154(b) by 0 days.

(21) Appl. No.: 15/816,413

(22) Filed: Nov. 17, 2017

(65) Prior Publication Data

US 2018/0140932 A1 May 24, 2018

(30) Foreign Application Priority Data

Nov. 21, 2016 (DE) ..... 10 2016 222 951

(51) Int. Cl.

| | |
|---|---|
| ***A63C 9/10*** | (2012.01) |
| ***A63C 9/06*** | (2012.01) |
| ***A63C 9/086*** | (2012.01) |
| ***A63C 9/20*** | (2012.01) |
| *A63C 9/08* | (2012.01) |

(52) U.S. Cl.

CPC ..... *A63C 9/10* (2013.01); *A63C 9/065* (2013.01); *A63C 9/086* (2013.01); *A63C 9/20* (2013.01); *A63C 9/0807* (2013.01)

(58) Field of Classification Search

CPC ..... A63C 10/14; A63C 10/28; A63C 10/285; A63C 9/10; A63C 9/20; A63C 9/085

See application file for complete search history.

(56) References Cited

U.S. PATENT DOCUMENTS

2011/0025003 A1 2/2011 Moore et al.
2011/0298196 A1* 12/2011 Lehner ..... A63C 9/0807 280/611

(Continued)

FOREIGN PATENT DOCUMENTS

CH 47443 7/1910
DE 10 2009 059 968 6/2011

(Continued)

OTHER PUBLICATIONS

German Application No. 10 2016 222 951.6, German Search Report dated Jul. 27, 2017.

(Continued)

*Primary Examiner* — James A Shriver, II
*Assistant Examiner* — James J Triggs
(74) *Attorney, Agent, or Firm* — Kilpatrick Townsend & Stockton LLP

(57) ABSTRACT

The present invention relates to a front unit of a touring binding, wherein the front unit comprises a bearing arrangement having a bearing element, wherein the bearing element is designed to hold a touring shoe on the front unit on a counter-bearing portion of the touring shoe so as to be pivotable about a transverse axis extending transversely to a glide board longitudinal axis, wherein a release path is defined on the bearing arrangement, along which path the counter-bearing portion of the touring shoe can exit the bearing arrangement, wherein the front unit further comprises a blocking portion designed to block the movement of the counter-bearing portion of the touring shoe along the release path when the front unit is in a blocked state, and to allow the movement of the counter-bearing portion of the touring shoe along the release path when the front unit is in a neutral state.

20 Claims, 5 Drawing Sheets

(56) References Cited

U.S. PATENT DOCUMENTS

| | | | | |
|---|---|---|---|---|
| 2014/0110919 | A1* | 4/2014 | Convert | A63C 9/10<br>280/615 |
| 2015/0335987 | A1* | 11/2015 | Nobile | A63C 9/22<br>280/615 |

FOREIGN PATENT DOCUMENTS

| | | |
|---|---|---|
| DE | 20 2010 001 835 | 6/2011 |
| DE | 10 2010 043 880 | 5/2012 |
| DE | 20 2013 012 101 | 3/2015 |
| DE | 20 2011 110 656 | 6/2015 |
| DE | 20 2009 019 128 | 11/2016 |
| EP | 2946818 | 11/2015 |
| WO | 2011015234 | 2/2011 |
| WO | 2015159163 | 10/2015 |

OTHER PUBLICATIONS

European Application No. 17202562.9, Search Report dated Apr. 5, 2018.

* cited by examiner 34
46
36
D
41
24
30
44a
38
D 52
34
41
54
38
36

34
41
74
38
36

46
44a
44
42
38
74
56
52
54
76
82

38
46A
52
54
A
54

46
B
38
38
46
B
L 74
54
8,12
C
38
46
C
52
74
54
52

36
48
34
30
78
50

36
48
45
76
80
40
47
50
78
41

TOURING BINDING TO BE FITTED TO A GLIDING BOARD

The present invention relates to a front unit of a touring binding to be fitted to a glide board, a blocking portion being able to block a release path of the front unit in order to prevent a touring shoe from exiting a bearing element.

DE 10 2009 059 968 A1 discloses a front unit of this kind, the front unit being substantially U-shaped and the release path extending along U or V-shaped grooves that are open at the top. This release path can be closed by detents held on pivot levers or pins guided in a linear manner. However, if a front unit of this kind freezes over, ice may form in the pivot region of the pivot lever or in the movement path of the pins, making it difficult or even impossible to enter or withdraw from the front unit since the mechanisms used are susceptible to environmental influences.

The object of the present invention is to provide a front unit of a touring binding that operates more effectively when environmental conditions are unfavourable.

According to the invention, this object is achieved by a front unit of a touring binding, the front unit comprising a bearing arrangement having a bearing element, the bearing element being designed to hold a touring shoe on the front unit on a counter-bearing portion of the touring shoe so as to be pivotable about a transverse axis extending transversely to a glide board longitudinal axis, a release path being defined on the bearing arrangement, along which path the counter-bearing portion of the touring shoe can exit the bearing arrangement, the front unit further comprising a blocking portion designed to block the movement of the counter-bearing portion of the touring shoe along the release path when the front unit is in a blocked state, and to allow the movement of the counter-bearing portion of the touring shoe along the release path when the front unit is in a neutral state, wherein, when moving from the neutral state into the blocked state, the blocking portion performs a rotational movement about an axis of rotation of the blocking portion, which axis extends transversely to a glide board longitudinal axis. Preferably, the transverse axis about which the touring shoe is pivoted coincides with the axis of rotation of the blocking portion. Preferably, the transverse axis about which the touring shoe is pivoted and/or the axis of rotation of the blocking portion extend transversely to a glide board longitudinal axis and in parallel with a glide board plane/glide board surface. Since the axis of rotation of the touring shoe is in substantially the same direction as the axis of rotation of the blocking portion, the blocking portion can move around the bearing element or together with the bearing element. In this way, the bearing element does not prevent the blocking portion from performing a rotational movement, meaning that a bearing surface of the blocking portion can be covered around the entire circumference thereof, as a result of which a dirt-resistant bearing can be provided for the blocking portion. The bearing element, in the form of a bushing or bearing bushing, can be designed to rotate in the bearing arrangement. The bearing element can be designed to hold a counter-bearing portion of the touring shoe in an opening that extends along the axis of rotation of the blocking portion. The bearing element can be mounted in the bearing arrangement in an insert or an insertion bushing. Preferably, a three-dimensional structure that can define the release path and/or an entry path is provided in the insert or insertion bushing.

In the front unit of the touring binding, the blocking portion can be formed on the bearing element, preferably integrally therewith, and the bearing element, when moving from the neutral state into the blocked state, can perform a rotational movement about an axis of rotation of the bearing element, which axis extends transversely to a glide board longitudinal axis. If the blocking portion on the bearing element is designed for conjoint rotation, the bearing element bearing, which is sturdy due it being designed to support the shoe, is also the bearing for the blocking portion, meaning that the bearing has a dual function; in addition, the movement between the blocked state and the neutral state is particularly reliable due to the sturdiness of the bearing.

It is also possible for the blocking portion to extend substantially in one direction along the axis of rotation of the bearing element, and/or the front unit further comprising an entry contour and/or a disengagement contour and/or a withdrawal contour that is formed on the bearing element at least in some portions, and the entry contour and/or the disengagement contour and/or the withdrawal contour preferably being formed as a recess substantially in one direction along the axis of rotation of the bearing element. If an entry contour and/or a disengagement contour and/or a withdrawal contour is provided on the bearing element, the bearing element has a plurality of functions and the overall front unit can thus be simplified, since additional parts for implementing these functions can be dispensed with. If the blocking portion extends substantially in one direction along the axis of rotation of the bearing element and, optionally, if the entry contour and/or the disengagement contour and/or the withdrawal contour is formed as a recess substantially in this direction, then, during rotation of the bearing element, these elements can be prevented from jamming during the rotation.

In particular, the withdrawal contour is designed to allow the touring shoe to release from the front unit, for example upon a rotational or pivoting movement.

Preferably, the front unit is designed to assume an entry state and/or a descent state and/or a withdrawal state, wherein, when moving between the blocked state and at least one of the neutral state, entry state, descent state and withdrawal state, and/or when moving between the descent state and withdrawal state, the bearing element performs a rotational movement about an axis of rotation of the bearing element, which axis extends transversely to a glide board longitudinal axis. In this way, the movement between the individual states of the front unit is made possible by one type of movement of the bearing element, so there is no need for a complex mechanism that is prone to breakdowns. In particular, the front unit can comprise an entry contour and/or a disengagement contour and/or a withdrawal contour formed on the bearing element at least in some portions.

In a more preferred embodiment, the release path extends substantially in parallel with the glide board longitudinal axis. In addition, the release path can extend substantially in parallel with a glide board plane. In this case, it is possible to produce a particularly secure binding of the glide board to the front unit since the front unit assists in a twist-to-disengage of the touring shoe about an axis substantially perpendicular to the glide board plane (Z-disengagement).

It is also conceivable for the bearing element to be designed to receive a counter-bearing portion of the touring shoe, which portion preferably protrudes from a front portion of the touring shoe. Snow and ice preferably accumulate on the touring shoe before using the glide board; however, having a protruding counter-bearing portion makes it particularly simple to remove these from the counter-bearing portion, compared with a depression provided as the counter-bearing portion on the touring shoe, and this improves the functionality and safety of the front unit. The counter-bearing portions of the touring shoe can be left-hand and right-hand pins that protrude laterally in opposite directions from the front of the shoe.

It is also possible for an entry path to be defined on the bearing arrangement and for said path to be designed to guide the counter-bearing portion of the touring shoe into the bearing element, the entry path extending substantially perpendicularly to the glide board plane when the front unit is in an entry state. As a result, upon entry, a force is exerted on the glide board substantially perpendicularly to the glide board plane, so that the glide board does not slip when stepping into the front unit.

Another aspect of the invention provides a front unit of a touring binding, preferably a front unit of a touring binding as described above, wherein the front unit comprises a bearing arrangement having a bearing element, wherein the bearing element is designed to hold a touring shoe on the front unit on a counter-bearing portion of the touring shoe so as to be pivotable about a transverse axis extending transversely to a glide board longitudinal axis, and wherein the front unit has a holding configuration and a withdrawal configuration, wherein the bearing arrangement and/or the bearing element performs a forward movement when the front unit moves from a holding configuration to a withdrawal configuration. This allows the front unit to interact with a heel unit of a touring binding in such a way that the heel unit need not have a steady open position (see heel unit from DE 10 2010 043 880 A1) since, when the front unit moves between a holding configuration and a withdrawal configuration by shifting the bearing arrangement and/or bearing element, a touring shoe can be removed from the heel unit (when moving into the withdrawal configuration) or pushed into the heel unit. In particular, the front unit of the touring binding can be designed to hold the touring shoe on the front unit when the front unit moves from the holding configuration to the withdrawal configuration, in which the bearing arrangement and/or the bearing element performs the forward movement. As a result, when the bearing element moves in the forward direction, the touring shoe is removed from the heel unit (normally present) and the touring shoe can then be disengaged from the front unit without being obstructed by the heel unit, and thus in a particularly convenient and safe manner, for example by being rotated sideways.

Preferably, the bearing arrangement performs a pivoting movement, preferably about a pivot axis extending transversely to the glide board longitudinal axis, when the front unit moves between the holding configuration and the withdrawal configuration. Pivot arrangements can be formed in a particularly simple and dirt-resistant manner, e.g. by using particularly dirt-resistant rotational bearings.

In a more preferred embodiment, the front unit further comprises a locking arrangement designed to prevent movement from the holding configuration into the withdrawal configuration when in a locked state, and to allow movement from the holding configuration into the withdrawal configuration when in an unlocked state. This improves the safety and functionality of the front unit since it is possible to prevent accidental movement from the holding configuration into the withdrawal configuration.

In particular, it is conceivable for the locking arrangement to comprise: a carriage guide, preferably having a carriage stop, and a carriage, a first support element, a second support element, a first pivot, a second pivot, a third pivot, and a lever having a first stop element and a second stop element, wherein the first, second and third pivots preferably extend in parallel with one another, wherein the first pivot is arranged immovably in relation to the carriage guide and the third pivot is arranged immovably in relation to the carriage, wherein the first support element interconnects the first and second pivots and mounting said pivots in a pivotal manner, and the second support element interconnects the second and third pivots and mounts said pivots in a pivotal manner, wherein the lever is mounted pivotally on the second pivot, wherein the first stop element engages on the second support element when the lever pivots out of a rest position in a first direction through a first angle, wherein the second stop element engages on the first support element when the lever pivots out of the rest position in the first direction through a second angle that is greater than the first angle. In the locked state, an arrangement of this kind is in a firm state, meaning that the movement from the holding configuration into the withdrawal configuration can be prevented particularly reliably.

In another aspect, the invention provides a front unit of a touring binding, in particular a front unit of a touring binding as described above, the front unit comprising a bearing arrangement having a bearing element, the bearing element being designed to hold a touring shoe on the front unit on a counter-bearing portion of the touring shoe so as to be pivotable about a transverse axis extending transversely to a glide board longitudinal axis, wherein the front unit is moved between a holding configuration and a withdrawal configuration of the front unit or the front unit is moved between a neutral state and a blocked state of the front unit by a tensile force being transmitted by means of at least one flexible element, preferably a cord, a chain, a flexible strap or a flexible bar. In particular, the front unit can also be moved between two states selected from a release state, an entry state and a withdrawal state of the front unit by a tensile force being transmitted by means of the flexible element. Transmitting a tensile force by means of at least one flexible element is substantially not restricted at all when snow and/or ice is present on the front unit since the surface for dirt to adhere to on a flexible element is predominantly small, so this dirt can be simply wiped or chipped off when a tensile force is transmitted.

In a more preferred embodiment, the front unit further comprises a pivotable lever, a first engagement portion designed for rotation together with the lever and a second engagement portion designed for rotation together with the bearing element, wherein the first engagement portion is connected to the second engagement portion for conjoint rotation by means of the flexible element, and wherein the flexible element pivots the lever into the rotational movement of the bearing element by transmitting a tensile force. By an arrangement of this kind, combining transmitting a tensile force by means of the flexible element with providing dirt-resistant rotational bearings makes it possible to further increase the dirt-resistance of the front unit.

In another aspect, the invention provides a system comprising an aforementioned front unit for a touring binding and a touring shoe, wherein the touring shoe comprises two counter-bearing portions, more preferably protrusions or pins, that preferably protrude sideways from a front portion of a sole of the touring shoe and of which at least one is designed to be held on the front unit on the bearing element of the front unit so as to be pivotable about the transverse axis extending transversely to the glide board longitudinal axis, wherein a position of the protrusions relative to one another and relative to the sole of the touring shoe is fixed. The advantages of the aforementioned front unit also apply to a system of this kind, it being particularly simple to remove ice and snow from protruding counter-bearing portions. The fixed arrangement of the counter-bearing portions makes it possible to dispense with a movable bearing mechanism for the counter-bearing portions, thereby further increasing the system's resistance to dirt. The counter-bearing portions can in particular protrude in opposite directions.

In relation to the advantages of rotational/pivot bearings compared with linear bearings, for example, it should be noted that a sliding carriage in a linear bearing can never cover the entire linear bearing, but rather there must always be a certain free path for the movement of the sliding carriage, making it difficult to prevent dirt from entering this free path. In rotational/pivot bearings, however, the inner bearing surface of the bearing can be enclosed around the entire circumference thereof by an outer bearing surface of the bearing, meaning dirt is particularly effectively prevented from entering. Sealing along the axis of rotation of the bearing can be produced merely by ensuring that the rotational elements fit together closely; however, specific sealing elements such as cover plates can also be provided on the end faces of the bearing or the sealing rings.

The following definitions can be used in the application: when the front unit is in a blocked state, a counter-bearing portion of the touring shoe is prevented from exiting the front unit, in particular along a release path, whereas said portion can exit the front unit when the unit is in a neutral state. Assuming the blocked state and/or neutral state can depend on an angular position of the bearing element in the bearing arrangement, or on the change in said position. When in a holding configuration, the front unit is in a configuration that is suitable for holding the shoe on the front unit, and when in a withdrawal configuration, the front unit is in a configuration in which withdrawal from the front unit is made possible and/or facilitated. Assuming the holding configuration and/or the withdrawal configuration can depend on an angular position of the bearing arrangement in relation to a base element of the front unit, or on the change in said position. When in a release state, the front unit is designed to release a counter-bearing portion of the touring shoe from the front unit, in particular from the bearing element, e.g. when disengaged for safety reasons. When in an entry state, the front unit is designed to receive a counter-bearing portion of the touring shoe in the front unit, in particular in the bearing element. When in a withdrawal state, the front unit is designed to allow and/or facilitate withdrawal from the front unit. Assuming the release state, entry state and/or withdrawal state can depend on an angular position of the bearing element in the bearing arrangement, or on the change in said position.

Additional preferred embodiments of the invention are set out in dependent claims 3 to 9.

The invention will be described below on the basis of embodiments of the invention, with reference to the accompanying drawings, in which:

FIG. 1*a* shows a front unit from a first embodiment of the invention in a blocked state;

FIG. 1*b* shows the front unit from the first embodiment in an entry state and a descent state;

FIG. 1*c* shows the front unit from the first embodiment in a withdrawal state;

FIG. 2*a* is a partial sectional view of the front unit from FIG. 1*a;*

FIG. 2*b* is a partial sectional view of the front unit from FIG. 1*b;*

FIG. 2*c* is a partial sectional view of the front unit from FIG. 1*c;*

FIG. 3*a* is a partial sectional view of the front unit from FIG. 1*a* in which the sectional plane is along a glide board central plane;

FIG. 3*b* is a partial sectional view of the front unit from FIG. 1*b* in which the sectional plane is along a glide board central plane;

FIG. 3*c* is a partial sectional view of the front unit from FIG. 1*c* in which the sectional plane is along a glide board central plane;

FIG. 4 is a view of a bushing of the front unit from FIG. 1*a;*

FIG. 5*a* is a plan view of the bushing from FIG. 4 and the section through it along A-A;

FIG. 5*b* is a plan view of the bushing from FIG. 4 and the section through it along B-B;

FIG. 5*c* is a plan view of the bushing from FIG. 4 and the section through it along C-C;

The embodiments of the front units described below are substantially symmetrical to the left and right of a central plane of the front unit, and therefore the following description will focus on the description of one side, unless stated otherwise, and the embodiments will include the corresponding left-hand or right-hand element or structure not described. In addition, it is clear from the drawings that there is only one of some parts of the front unit, e.g. the lever, despite the substantially symmetrical construction.

Where reference is made to directions, planes and the like in this application, these should be taken in relation to a front unit of a touring binding fitted under normal operating conditions, and therefore the directions (front, back, left, right) and planes of the glide board in the normal operating state also apply to the front unit of the touring binding. Furthermore, axles and pivots can be formed as spindles within the context of this application.

First Embodiment

Figure 1A:
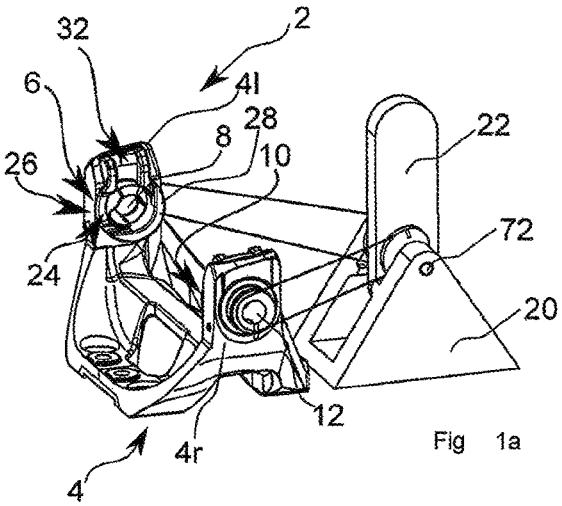
Figure 1B:
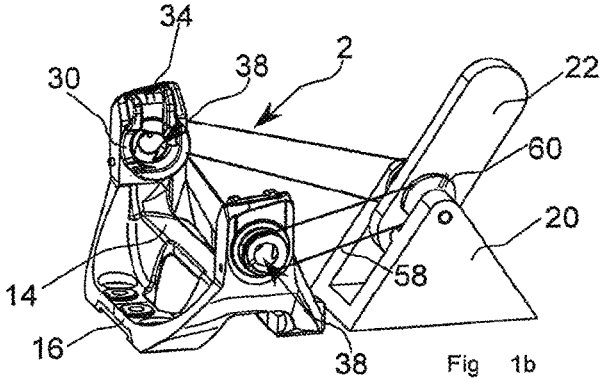
Figure 1C:
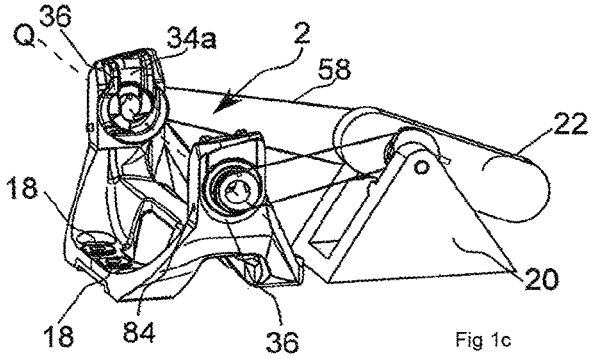

FIG. 1 shows the front unit 2 of a touring binding according to a first embodiment, comprising a bearing arrangement 4 having a first, left-hand bearing element 6 having a left-hand opening 8, and a second, right-hand bearing element 10 and a right-hand opening 12. By means of the openings 8 and 12, each of the bearing elements 6 and 10, respectively, is designed to receive a counter-bearing portion of a touring shoe, which portion preferably projects from a front portion of the touring shoe, and thus to hold the touring shoe on the front unit 2 so as to be pivotable about a transverse axis Q extending transversely to a glide board longitudinal axis. The transverse axis Q can extend transversely to the glide board longitudinal axis and in parallel with a glide board plane/glide board surface.

The bearing arrangement 4 is preferably U-shaped and can comprise particularly light material, such as aluminium, titanium or a carbon fibre composite. To increase the rigidity of the bearing arrangement 4, the arrangement can comprise a reinforcing web 14 that interconnects legs 4*l*, 4*r* of the U-shaped bearing arrangement 4, preferably at a distance from a base 16 of the U-shaped bearing arrangement. The base 16 can comprise openings 18 for fitting the front unit of the touring binding. The front unit 2 can comprise, either integral with the bearing arrangement 4 or separate therefrom, a lever support 20 having a lever 22.

The front unit 2 is particularly suited to holding a touring shoe, as in DE 10 2009 059 968 A1 having protruding/projecting counter-bearing portions, in particular bearing pins, in a pivotal manner on the front unit. To allow the touring shoe to be disengaged from the front unit 2 by means of a safety disengagement (Z-disengagement) upon the application of excessive lateral forces that attempt to rotate the touring shoe out of the front unit 2, it is preferable for the counter-bearing portions to be able to be moved into the touring shoe counter to a spring force or the like. By way of example, EP 2 946 818 A1 describes a corresponding arrangement.

To allow a Z-disengagement of this kind in a defined manner, a release path 24 is defined on the bearing arrangement 4, preferably on each of the U-shape legs 4*l*, 4*r*. The release path 24 can be defined by a three-dimensional structure in the bearing arrangement 4; this structure can, for example, be either a break 26 in a collar 28 or a recess 30 that allows and/or guides a movement of the counter-bearing portions of the touring shoe. Preferably, the release path 24 extends substantially in parallel with a glide board plane. Furthermore, an entry path 32 can be defined on the bearing arrangement 4, which path is preferably defined by means of a recess 34 and along which a counter-bearing portion of the touring shoe can enter, for example slide into, the front unit 2 of the touring binding in order to be held on the front unit 2. The recess 34 or the base portion 34*a* thereof can extend substantially perpendicularly to the axis Q. The entry path 32 preferably extends perpendicularly to the glide board plane. Preferably, the release path 24 and the entry path 32 are each defined in an insert 36 of the bearing arrangement 4 and are preferably each formed by a recess 34 and 30, respectively, as a result of which the material of the insert 36, for example stainless steel or a particularly hard aluminium alloy, can be adapted to the load from the counter-bearing portions of the touring shoe. The insert 36 can comprise a protrusion 48 that protrudes in the circumferential direction and which, when fitted, engages in a corresponding recess 45 in one leg 4*l*, 4*r* of the U-shaped bearing arrangement 4, thus defining the angular position and penetration depth in the bearing arrangement in one direction of the insert 36. The recess 34 is preferably formed in the protrusion 48. The insert 36 can be pressed into an opening 47 in one of the legs 4*l*, 4*r* of the U-shaped bearing arrangement 4.

Preferably, the insert 36 is supported with respect to one of the legs 4*l*, 4*r* in one direction along the axis Q by a step 50 on the insert 36, which step strikes the material of the leg 4*l* or 4*r*. Preferably, the collar 28 is formed on the insert 36. The collar 28 can prevent the counter-bearing portion moving out of the bearing element in a substantially downward direction and/or in a substantially forward direction.

Each of the bearing elements 6 and 10 can be designed to be rotatable about the axis of rotation Q which extends transversely to a glide board longitudinal axis and about which a touring shoe can be pivotally held on the front unit. Preferably, a bearing element of this kind is formed as a bushing or bearing bushing 38 that is in turn mounted rotatably in the insert 36 by means of a bearing 40. The bearing 40, which is preferably in the form of a plain bearing, can be protected by seals (not shown) against environmental influences such as moisture or dust. The bearing 40 can also be in the form of a ball bearing (not shown).

In the first embodiment, the front unit 2 has a blocking portion 42 that can preferably be formed on the bearing element 6 or 10, in particularly in an integral manner therewith. In the first embodiment, the blocking portion 42 is integral with the bushing 38 and preferably comprises an inner surface 44 extending substantially around the axis Q, it being possible to form a cover 46 on the outer circumference of the bushing 38 in the region of the blocking portion 42, which cover can prevent entry into the front unit 2, as will be described later. In particular, the angular region (in relation to rotation about the axis Q) covered by the cover 46 can be smaller than the angular region (in relation to rotation about the axis Q) covered by the inner surface 44. The blocking portion 42 can be considered to be a protrusion or collar that has at least one break in the circumferential direction and preferably extends along the axis of rotation Q of the bearing element. The opening 8 or 12 is preferably formed substantially along the axis of rotation of the bearing element (in this case the bushing 38) and is designed to receive a counter-bearing portion of the touring shoe, so that the pivot axis of the touring shoe in the front unit 2 can coincide with the axis of rotation of the bearing element. The bearing element (in this case the bushing 38) is designed to rotate about the pivot of the touring shoe in the front unit 302.

An entry contour 52 and/or a disengagement contour 54 and/or a withdrawal contour 74 can be formed on the bushing 38, it being possible for each individual contour 52, 54 and 74 to be formed as a recess, substantially in a direction determined by the axis Q, in relation to a plane L that can define an end of the bushing 38. Preferably, the entry contour 52 is formed adjacently to the disengagement contour 54 in the circumferential direction of the bushing 38.

Figure 2A:
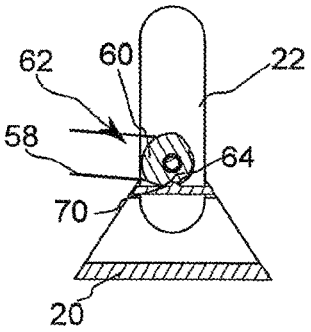
Figure 2B:
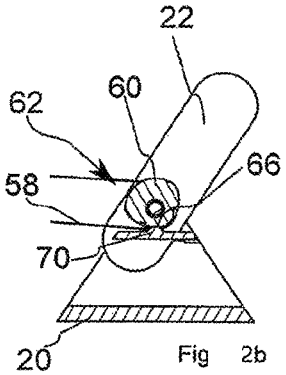
Figure 2C:
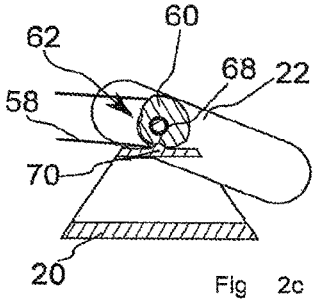
Figures 3A, 3B, 3C, 4, 5A, 5B, 5C, 6, 7:
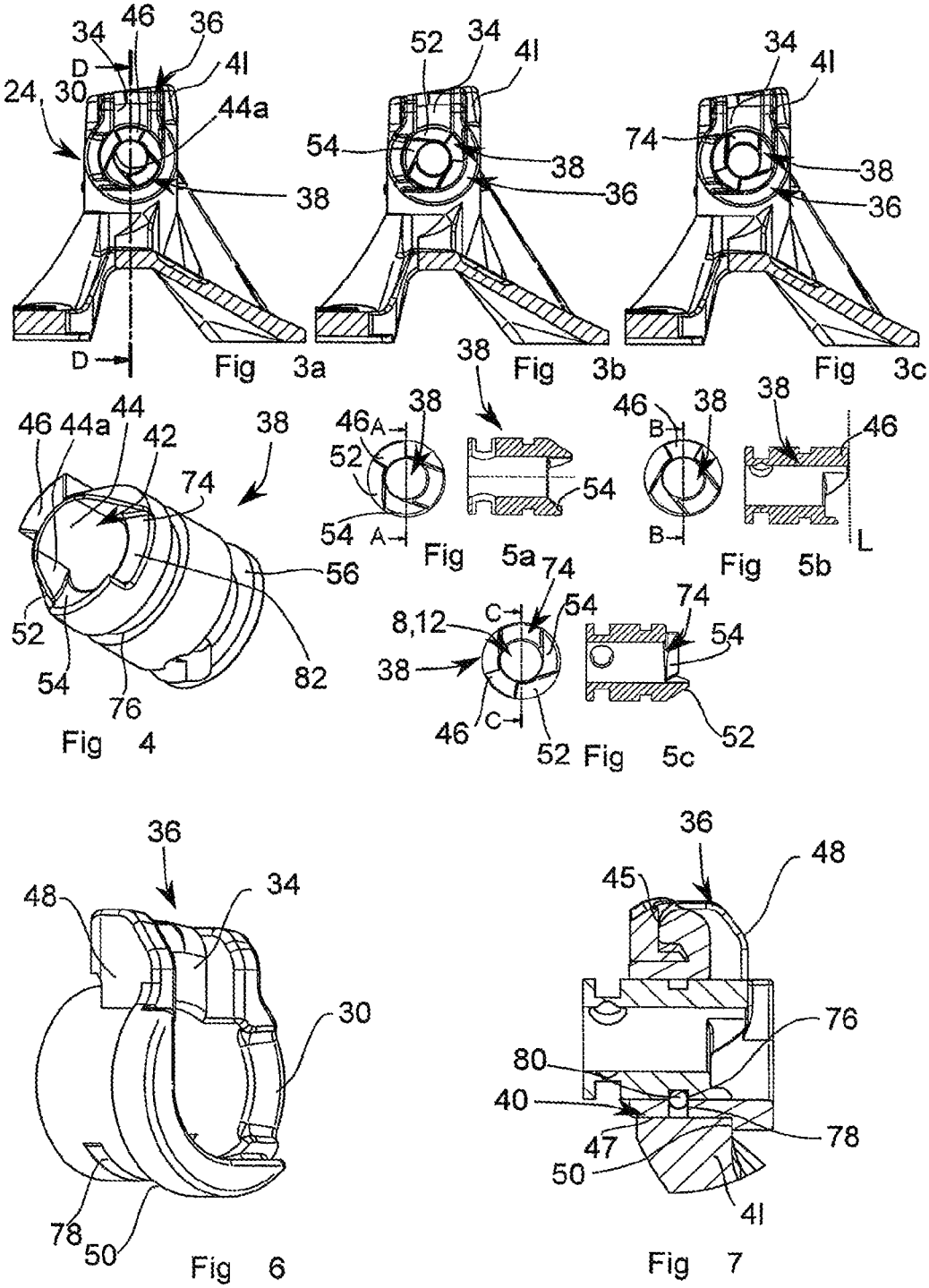
FIG. 6 is a view of an insert of the front unit from FIG. 1*a;*
FIG. 7 shows part of a section along D-D from FIG. 3*a;*
Figure 8:
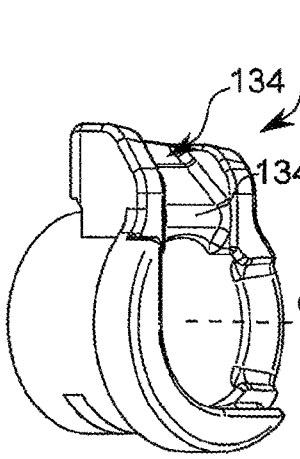
FIG. 8 is a view of an insert of a front unit from a second embodiment of the invention.
Figure 10:
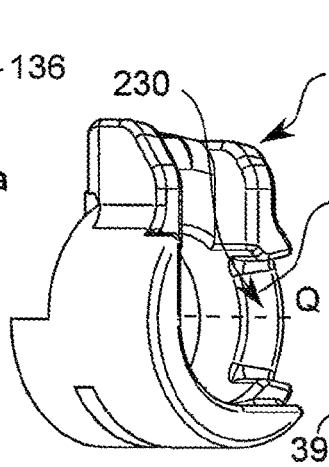
FIG. 10 is a view of an insert of a front unit from a third embodiment of the invention.
Figure 13:
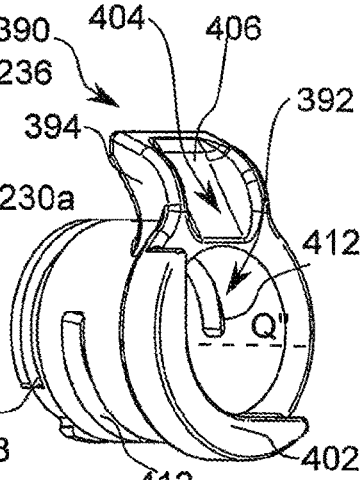
FIG. 13 is a view of an insert of the front unit from FIG. 12.

A groove 56 in the form of an engagement portion for receiving a flexible element 58, for example a cord, a flexible strap or a chain, can be formed in the bushing 38. Here, it is also possible to provide a toothed wheel for receiving a chain, or to provide only two partial grooves, at the ends of which a flexible bar for transmitting a tensile force can be fastened. A further engagement portion acting as a corresponding counterpiece, according to the design of the flexible element 58, is provided on the lever 22; in the case of a cord, this could for example be a roller element 60 having a groove, the roller element 60 being able to be designed for rotation together with the lever 22. The flexible element 58 preferably connects the groove 56 to the groove in the roller element 60, whereby rotation of the roller element 60 and thus of the lever 22 is preferably coupled to rotation of the bushing 38. Two roller elements 60 having grooves can be intended for use with two flexible elements. FIGS. 2*a* to 2*c* are partial sections, the sectional plane passing through the roller element 60 to the right and being in parallel with the glide board central plane.

The lever 22 and the lever support 20 are preferably part of an indexing device 62 of the front unit that can make the lever 22 latch into a plurality of positions. Preferably, three depressions 64-68 are formed in the roller element 60 and can interact with a flexibly mounted or spring-mounted protrusion 70 on the lever support 20. Alternatively, a depression can be formed in the lever support 20 and three preferably flexibly mounted or spring-mounted protrusions can be formed on the roller element 60.

The entry contour 52 is preferably formed in such a way that it is aligned with the entry path 32, in particular with the recess 34, when the recess 66 interacts with the protrusion 70. The front unit is then in an entry state. The entry contour 52 can be an entry chamfer (a surface that is preferably oblique with respect to the axis Q and preferably points outwards in relation to the axis Q) by means of which chamfer a counter-bearing portion of the touring shoe guided through the entry path 32 can slide into the opening 8 or 12 when in the entry state; at the same time, the counter-bearing portion of the touring shoe can enter the touring shoe, preferably counter to a restoring force. Instead of an entry chamfer, an entry contour (in this case the entry contour 52) can also be in the form of a rounded part, a notch, a guide rail or the like.

If the recess 66 interacts with the protrusion 70, the disengagement contour 54 is aligned with the release path 24, and therefore the front unit 2 is in a descent state, which can preferably coincide with the entry state. In the descent state, the counter-bearing portion of the touring shoe can slide out of the bearing element, preferably counter to a restoring force provided by the touring shoe, and out of the front unit in the event of a lateral force along the disengagement contour 54. Preferably, the disengagement contour 54 is formed as a disengagement chamfer (a surface that is preferably oblique with respect to the axis Q and preferably points inwards in relation to the axis Q). If another intermediate angle is provided between the disengagement contour 54 and the entry contour 52, the indexing device can be supplemented by a corresponding additional recess in the roller element 60, so that the bushing 38 can assume a separate angular position for the descent state.

If the lever 22 is pivoted about an axis 72 of the lever 22 in such a way that the recess 68 interacts with the protrusion 70, the bushing 38 is rotated in such a way that the withdrawal contour 74 is substantially aligned with the entry path 32, in particular with the recess 34, thereby placing the front unit 2 in a withdrawal state. Preferably, the withdrawal contour 74 is provided with a base portion 82 that extends substantially perpendicularly to the axis Q and is in such a position along the axis Q that, when the counter-bearing portion moves out of the opening 8 or 12, the counter-bearing portion is preferably not resisted by the withdrawal contour 74.

If the lever 22 is now pivoted about the axis 72 in such a way that the recess 64 interacts with the protrusion 70, the inner surface 44 of the blocking portion 42, in particular the sub-surface 44*a*, blocks the release path 24 and the front unit 2 is in a blocked state. When in the blocked state, the front unit 2 is designed so that the touring shoe can pivot about the axis Q and is held on the front unit 2 preferably non-detachably, as is common in a pin binding when climbing in backcountry skiing. In the blocked state, the cover 46, which preferably has an outer surface (outer in relation to the axis Q) in parallel with the axis Q, is substantially flush with the entry path 32 or the recess 34, and therefore a touring shoe cannot enter the front unit in the blocked state.

In the entry state and the descent state, the blocking portion 42 does not block the release path 24 and allows a movement of the counter-bearing portion along the release path 24, so that the front unit 2 is in a neutral state.

Preferably, the bearing 40 has a first guide groove 76 formed in the bushing 38 and a second guide groove 78 that is formed in the insert 36 and is continuous in the radial direction. The bearing 40 can then be assembled by inserting the bushing 38 into the insert 36, which is then inserted into the opening 47, a rod/bar 80 being inserted into the two guide grooves 76 and 78 through an opening 84 in the leg 4*l* and 4*r*, respectively. As a result, a position of the insert 36 and of the bushing 38 along the axis Q can be fixed.

Alternatively, the indexing device 62 can be omitted, and each bearing element can be provided with a separate indexing device having a manual rotation device for each bearing element. The manual rotation device can be in the form of a radially protruding portion on the bushing 38 (an example of this is the anti-slip guard 368 in the fourth embodiment). In order to provide an indexing device on a bearing element, by way of example a plurality of recesses can be formed in the bushing 38, in particular in place of or in addition to the groove 56, and a protrusion can be formed in a flexible or spring-loaded manner on the leg 4*l*, 4*r* of the U-shaped bearing arrangement 4 in which the respective bushing 38 is mounted, which protrusion can engage in the recesses in the bushing 38, similarly to the interaction of the protrusion 70 with the recesses 64 to 68 in the indexing device 62, in order to hold the bushing 38 in a desired position. In order to rotate the bushing 38 into another desired position, in this case a torque can be overcome, so that the protrusion is pushed out of the recess in the bushing 38 and can engage in another recess in the bushing 38 when it reaches the next desired position. As with the indexing device 62, the recesses in the bushing 38 can be selected in such a way that the protrusions mounted in a flexible or spring-loaded manner on the legs 4*l*, 4*r* engage in the next depression in the bushing 38 only when a desired state or a desired configuration of the front unit is reached.

Second Embodiment

In the following, only the differences from the first embodiment will be described. Elements that substantially correspond to those in the first embodiment are provided with reference numerals increased by 100 compared with the elements in the first embodiment, apart from reference signs for axes.

A front unit of a touring binding in the second embodiment differs from the front unit 2 in the first embodiment on account of the design of both the bushing and the insert. In particular, the bushing 138 in the second embodiment comprises a blocking portion 142 having an inner surface 144 and a cover 146, a disengagement contour 154 and/or an entry contour 152, the disengagement contour 154 preferably being formed substantially on a side of the bushing 138 that is opposite a centre of the blocking portion 142. The disengagement contour 154 is also the withdrawal contour of the bushing 138, meaning that an indexing device of the front unit in the second embodiment is adapted to corresponding angular positions. Two entry contours 152 can be provided, so that the bushing 138 can be used on the right-hand and left-hand side of the front unit.

The insert 136 in the second embodiment comprises a recess 134, the base 134*a* of which is arranged at an acute angle to the axis Q and points outwards in relation to the axis Q.

Figure 9:
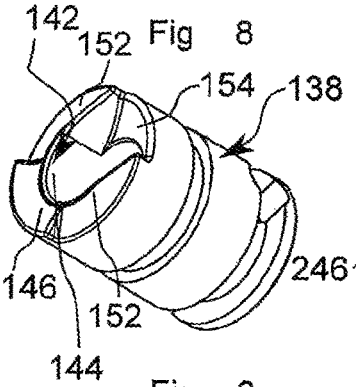
FIG. 9 is a view of a bushing of the front unit from the second embodiment of the invention.
Figure 11:
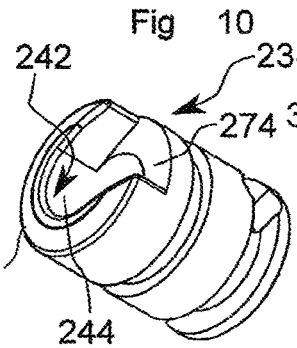
FIG. 11 is a view of a bushing of the front unit from the third embodiment of the invention.
Figure 14:
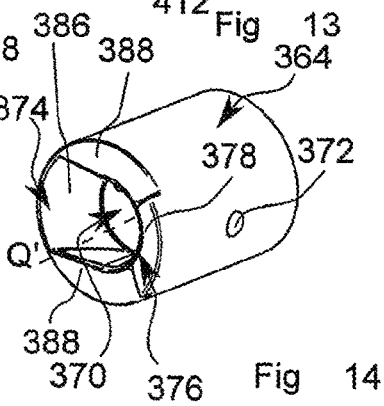
FIG. 14 is a view of a bushing of the front unit from FIG. 12.

It can be seen in FIG. 9 that the bushing 138 in the second embodiment has a blocking portion 142 formed by a circumferential portion of the bushing 138 that protrudes in the axial direction on the shoe side. By contrast, the disengagement contour 154 forms a release portion that is associated with the release path and which is a circumferential portion of the bushing 138 that is axially set back with respect to the blocking portion 142. In particular, the release portion (the disengagement contour 154) is formed by a release chamfer that extends obliquely with respect to the axis of rotation, in this case in particular at an angle of between approximately 30° and approximately 60° to the axis of rotation, and faces the axis of rotation. During the disengagement procedure, the pin provided on the shoe can slide down on the chamfer of the disengagement contour 154 and thus exit the bushing, releasing the shoe.

In addition, the bushing 138 in the second embodiment comprises the entry contour 152, which is formed by an entry chamfer, the entry chamfer extending obliquely with respect to the axis of rotation, in this case in particular at an angle of between approximately 30° and approximately 60° to the axis of rotation, and faces away from the axis of rotation. Accordingly, when stepping into the binding, a pin provided on the shoe can slide down along the entry chamfer of the entry contour 152 and enter the bushing 138.

In a particularly advantageous manner, the chamfers of the disengagement contour 154 and entry contour 152 interact with pins held on the shoe so as to be axially movable and in a manner preloaded by a spring. Alternatively or additionally, the bushing or bearing arrangement of the binding can be movable in the axial direction.

It can also be seen in FIG. 9 that, in the second embodiment, the blocking portion 142, the disengagement contour 154 and the entry contour 152 are formed on the bushing 138 at three circumferential portions of the bushing 138 that are offset from one another in the circumferential direction. The bushing 138 can thus be adjusted in at least three different rotational positions in order to implement the various functions: entry, walking position and descent position. When moving between the functions, the bushing 138 can in each case perform a rotational movement through an angle $$\alpha=\beta+n*90°$$

where $20° \leq \beta \leq 70°$ and $n \geq 0$ is a natural number.

Third Embodiment

In the following, only the differences from the first embodiment will be described. Elements that substantially correspond to those in the first embodiment are provided with reference numerals increased by 200 compared with the elements in the first embodiment, apart from reference signs for axes. The front unit in the third embodiment for a touring binding is particularly suitable for holding a touring shoe on the front unit so as to be pivotable about a transverse axis Q, extending transversely to the glide board longitudinal axis, by means of two counter-bearing portions, more preferably by means of protrusions or pins, protruding sideways from a front portion of a sole of the touring shoe, a position of the protrusions relative to one another and relative to the sole of the touring shoe being fixed. Touring shoes of this kind are known from the prior art, for example from DE 10 2009 059 968 A1.

A front unit of a touring binding in the third embodiment differs from the front unit 2 in the first embodiment on account of the design of both the bushing and the insert.

In particular, a bushing 238 in the third embodiment has a blocking portion 242 having an inner surface 244, a cover 246 and a withdrawal contour 274. The withdrawal contour 274 also has the function of a disengagement contour and an entry contour, the entry state and withdrawal state coinciding in this case, unlike in the first embodiment. An indexing device of the front unit in the third embodiment is adapted to corresponding angular positions of the contours.

In the descent state, the touring shoe at the front unit in the third embodiment is achieved by the front unit interacting with a heel unit (not shown) in that the heel unit prevents the touring shoe from slipping out along a release path. In particular, the heel unit can press the counter-bearing portions of the touring shoe against the inner surfaces 244 by means of a pretensioning apparatus. When the touring shoe is disengaged at a heel unit for safety reasons, in particular a Z-disengagement, the counter-bearing portions of the touring shoe can exit the front unit along the release path against substantially no resistance. In the third embodiment, therefore, the mechanism responsible for the safety disengagement is transferred to the heel unit, whereas the front unit is designed to not prevent a safety disengagement brought about by the heel unit.

An insert 236 in the third embodiment has a recess 230, the base 230*a* of which extends substantially perpendicularly to the axis Q and is of such a depth that the recess 230 provides substantially no resistance to a counter-bearing of a touring shoe during a disengaging movement.

Fourth Embodiment

A front unit 302 in a fourth embodiment comprises a bearing arrangement 304 which, when viewed in a forward/backward direction, preferably has a U-shape, which can be formed by legs 304*l*, 304*r* and a base portion 306. Preferably, the base portion 306 extends in a forward/backward direction, meaning that, when viewed transversely to a glide board longitudinal axis, each of the legs 304*l*, 304*r* substantially forms a L-shape together with the base portion 306, it not being necessary for there to be a right angle between the base portion 306 and either of the legs 304*l*, 304*r*.

The bearing arrangement 304 is preferably mounted on a base element 308, which is fixed to the glide board, so as to be pivotable about a first pivot 310. In the forward/backward direction, the base element 308 preferably has a U-shape, a left and right-hand side of the U-shape being able to have a plurality of sub-legs. A first sub-leg 312*l*, 312*r* on a left or right-hand side can be formed as a stop for a corresponding leg 304*l*, 304*r* of the bearing arrangement 304. A second sub-leg 314*l*, 314*r* on a left or right-hand side can be formed as a support for a respective spindle 316*l*, 316*r* of the first pivot 310. The spindles 316*l*, 316*r* preferably together form the pivot 310. In a preferred embodiment, it is conceivable to assign each of the two sub-legs 314*l*, 314*r* a corresponding inner axle bearing 314*li*, 314*ri* on a left or right-hand side, preferably in the form of a lug as an element of the base element 308, in order to support the corresponding left and right-hand side spindles 316*l*, 316*r*. Preferably, the base element 308 is integral with at least one of the second sub-legs 314*l*, 314*r*, the first sub-legs 312*l*, 312*r* and the inner axle bearings 314*li*, 314*ri*.

Preferably, the base element 308 also comprises a plurality of fitting openings 318, by means of which the front unit 302 can be fastened to a glide board by means of screws or similar fasteners.

At a preferably front end 320 of the base portion 306, a lever 322 is preferably arranged on a second pivot 324, which is preferably formed by a spindle. The base portion 306 connects the pivots 310 and 324 as a first support element. In addition, a second support element 326 is preferably pivotally arranged on the base portion 306 on the second pivot 324. The support element 326 preferably supports a third pivot 328 formed as a spindle. It is conceivable to pivotally attach a carriage 330 to the second support element 326 by means of the spindle forming the third pivot 328, so that the third pivot 328 can be formed in an immovable manner with respect to the carriage 330. The carriage 330 is preferably slidably guided on a carriage guide 332 of the base element 308. The carriage guide 332 preferably comprises a guide rod 334 which is held by a front support 336 and a rear support 338. In a preferred embodiment, the carriage 330 is preloaded towards the stop protrusion 337 by means of a spring 340, the spring 340 preferably being arranged between the carriage 330 and the rear support 338. Preferably, the supports 336 and 338 are arranged so as to be immovable with respect to the base element 308, so that the carriage guide 332 is arranged so as to be immovable with respect to the first pivot 310. The base portion 306, the second support element and the carriage 330 can form at least part of a locking arrangement of the front unit 302 by means of the corresponding pivots 310, 324 and 328, the carriage guide 332 and the stop protrusion 337.

The first, second and third pivots 310, 324 and 328 are preferably oriented in parallel with one another.

Figure 15:
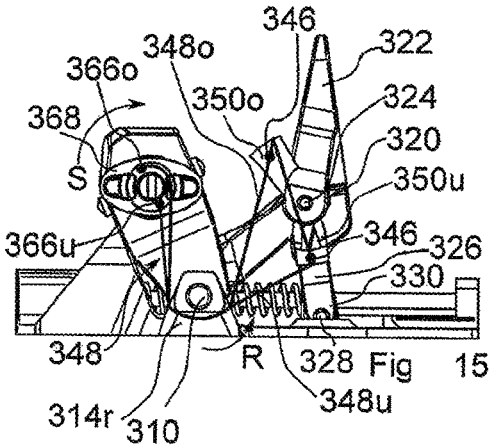
FIG. 15 is a side view of the front unit from FIG. 12.
Figure 16:
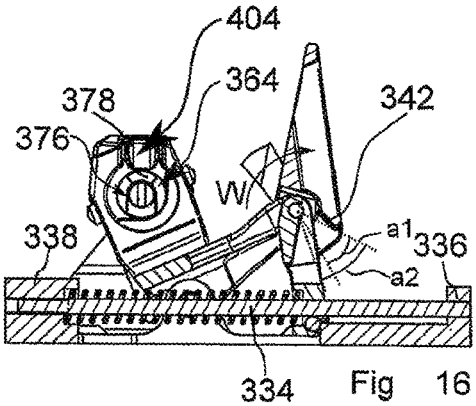
FIG. 16 is a sectional view, along a glide board central plane, of the front unit from FIG. 12 in a blocked state.
Figure 17:
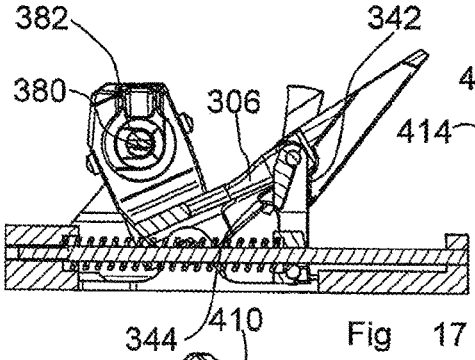
FIG. 17 is a sectional view, along a glide board central plane, of the front unit from FIG. 12 when passing through a dead centre of a second support element.
Figure 18:
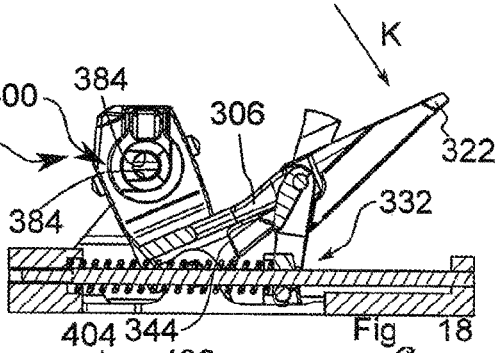
FIG. 18 is a sectional view, along a glide board central plane, of the front unit from FIG. 12 in an unlocked state.
Figure 19:
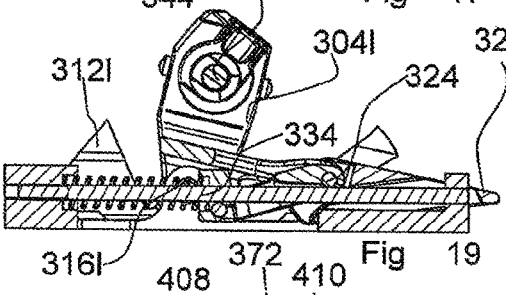
FIG. 19 is a sectional view, along a glide board central plane, of the front unit from FIG. 12 in a withdrawal state and a withdrawal configuration.

A first stop element 342 is preferably arranged on the lever 322 and engages on the second support element 326 when the lever 322 pivots in direction W out of the rest position shown in FIGS. 15 and 16 through a first angle a1 (for simplification, this angular position of the lever 322, preferably in relation to the base portion 306, is also referred to as a1). More preferably, a second stop element 344 is arranged on the lever 322 and engages on the base portion 306 when the lever 322 pivots in direction W out of the rest position shown in FIGS. 15 and 16 through a second angle a2 (for simplification, this angular position of the lever 322, preferably in relation to the base portion 306, is also referred to as a2), where a2>a1. It should be noted that the angles a1 and a2 are shown schematically in the drawings, and that the difference between a1 and a2 corresponds to the angle through which the lever 322 has to be rotated in FIG. 20 in order for the second stop element 344 to strike the base portion 306.

On the lever 322, preferably on the left and/or right-hand side, there is arranged at least one, preferably two engagement points 346 for a flexible element 348 (optionally a left and a right-hand flexible element 348 respectively), in which the flexible element 348, formed in this case in particular as a cord, is arranged on the lever 322 in a preferably immovable manner. In a preferred embodiment, the engagement points 346 are arranged on each lever arm 350*o*, 350*u*. It should be noted that the course of the flexible element 348 in the drawings, in particular in FIG. 15, is shown only schematically in parts for reasons of clarity.

Alternatively, by tensioning the flexible element 348, sufficient friction can be applied to bearing surfaces of the lever arms 350*o*, 350*u* for the flexible element 348 to be substantially fixed in position relative to the lever arms 350*o*, 350*u* owing to the friction. In a particularly preferred embodiment, an upper lever arm 350*o* comprises a bearing surface 352 in the form of a groove 354, and a lower lever arm 350*u* can comprise a bearing surface 356 in the form of an inner surface of an opening 358.

Figure 12:
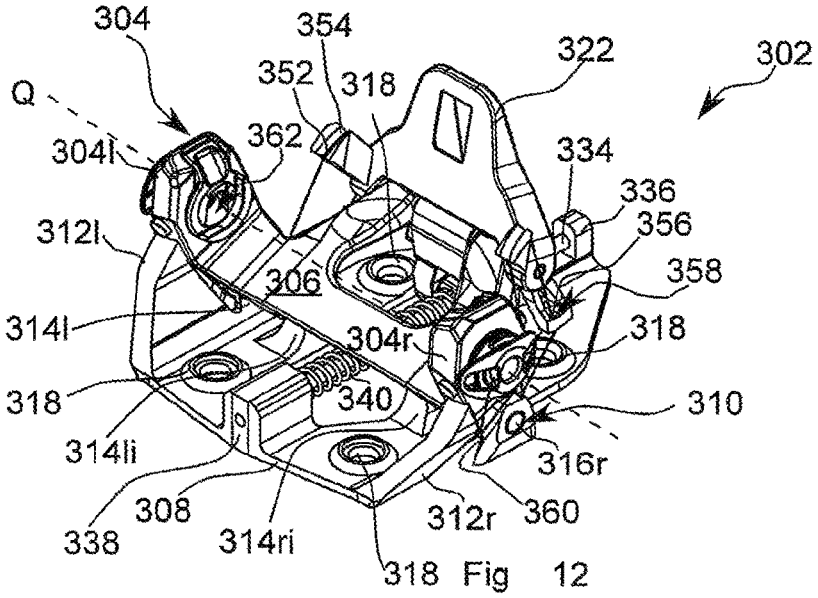
FIG. 12 is a view of a front unit from a fourth embodiment of the invention in a blocked state and a holding configuration.

By means of the engagement points 346 or the corresponding bearing surfaces (referred to generally as "engagement portions"), a tensile load or tensile force dependent on a rotation direction of the lever 322 can be transmitted by means of a first (in this case upper) portion 348*o* or a second (in this case lower) portion 348*u* of the flexible element 348. The upper portion 348*o* and the lower portion 348*u* of the flexible element 348 are preferably guided relative to a bearing element 362 via a deflection 360, only the left-hand bearing element being shown; the right-hand bearing element is hidden in FIG. 12. Preferably, the deflection 360 is designed as a groove or a plurality of grooves that guide the upper portion 348*o* and the lower portion 348*u* of the flexible element 348 into individual grooves. Preferably, the deflection 360 is formed on the second sub-leg 314*l*, 314*r*. The bearing element 362 preferably rotates about the glide board transverse axis Q.

The left or right-hand bearing element 362 is preferably formed as a bushing 364. On the bushing 364, a first engagement point 366*o* (engagement portion) is provided for fixing in position a first portion, preferably an end of the flexible element 348, and a second engagement point 366*u* (engagement portion) is provided for fixing in position a second portion, preferably another end of the flexible element 348. In a preferred embodiment, an anti-slip guard 368 in the form of a plate is provided on the bushing 364 and holds and/or guides the flexible element 348 in a region between the anti-slip guard 368 and a leg 304*l*, 304*r*. The anti-slip guard 368 can also be used in an emergency situation to rotate the bushing 364. The anti-slip guard 368 can be formed on the bushing 364 by means of a pressing process or bonding process, by means of connecting elements such as screws or rivets, or by any other suitable means. Rotation of the lever 322 is preferably coupled to rotation of the bushing 364 by means of the engagement points 366*o*, 366*u* and 346 or the corresponding bearing surfaces.

The bushing 364 preferably has a through-opening 370 formed along a bushing axis Q', which preferably coincides with a glide board transverse axis Q when fitted. Furthermore, the bushing 364 preferably has a through-opening 372 that is formed substantially transversely to the bushing axis Q' and preferably penetrates opposite wall portions of the bushing 364. The through-opening 370 is preferably formed substantially along the axis of rotation of the bearing element 362 (in this case the bushing 364) and is designed to receive a counter-bearing portion of the touring shoe, so that the pivot axis of the touring shoe in the front unit 302 can coincide with the axis of rotation of the bearing element 362. The bearing element (in this case the bushing 364) is designed to rotate about the pivot axis Q of the touring shoe in the front unit 302. The transverse axis Q can extend transversely to the glide board longitudinal axis and in parallel with a glide board plane/glide board surface.

At one end 374, which faces a counter-bearing of a touring shoe when in the ready-for-use state, the bushing 364 comprises a blocking portion 376 that preferably comprises a cover 378 and/or an inner surface 380, wherein, in a more preferred embodiment, the inner surface has a curved portion 382 and at least one, in particular two portions 384 extending in a substantially planar manner. If two portions 384 extending in a planar manner are provided, they can be formed substantially in parallel with one another. A disengagement contour 386 can also be provided on the bushing 364 and can be formed as a recess extending substantially along the axis Q', in particular as a disengagement chamfer in relation to the axis Q'. In addition, the bushing 364 can comprise at least one, preferably two entry contours 388. If two entry contours 388 are used, the same bushing 364 can be used for a left and right-hand side of the front unit 302. Preferably one of the entry contours 388, more preferably both contours, is formed as a recess along the axis Q', in particular as an entry chamfer in relation to the axis Q'.

In a preferred embodiment, the bushing 364 is mounted in an insert 390, which in particular can be mounted in a leg 304*l*, 304*r*. The insert 390 preferably has an opening 392 formed along an insert axis Q" of the insert 390, the insert axis Q" preferably substantially coinciding with the bushing axis Q' and/or the axis Q when the insert 390 is fitted. The insert 390 preferably has a protrusion 394 that extends substantially in the radial direction in relation to the insert axis Q", so that the protrusion 394 enters a corresponding recess in a corresponding leg 304*l*, 304*r* when the insert 390 is inserted and thus the angular position of the insert 390 in relation to the insert axis Q" is fixed in said corresponding leg 304*l*, 304*r*. The opening 392 is preferably substantially a cylindrical opening, the cylinder axis of which can coincide with the insert axis Q".

Optionally, the insert has at least one, preferably two cut-out grooves 412 that are preferably not interconnected and/or are preferably not around the entire circumference and/or are preferably designed to penetrate the wall material of the insert 390. Furthermore, the insert 390 can comprise a groove 398 that can fix the position of the insert 390 in relation to the corresponding leg 304*l*, 304*r* in one direction along the insert axis Q", preferably by means of a C-ring (circlip or C-shaped grooved ring). The position of the insert 390 in relation to the corresponding leg 304*l*, 304*r* in another direction along the insert axis Q" can be fixed by means of the protrusion 394 or by means of an edge 396 of a collar 402 that preferably projects/protrudes in the radial direction in relation to the insert axis Q". The collar 402 can prevent the counter-bearing portion from moving out of the bearing element in a substantially downward direction and/or in a substantially forward direction. The position of the insert 390 in relation to the corresponding leg 304*l*, 304*r* can be fixed by at least one pin 408, preferably two pins 408, engaging in one of the cut-out grooves 412, preferably in an end portion of the particular cut-out groove 412, and engaging in at least one opening (not explicitly shown) in the corresponding leg 304*l*, 304*r*. The position of the bushing 364 along the axis Q' or Q" or Q in relation to the insert 390 can be secured by a pin 410 engaging in the through-opening 372 and in both of the cut-out grooves 412.

To allow a Z-disengagement in a defined manner, a release path 400 is defined on the bearing arrangement 304, preferably on each of the U-shape legs 304*l*, 304*r*. The release path 400 can be defined by a three-dimensional structure in the bearing arrangement 304; this structure can, for example, be a break 414 in the collar 402 that can allow and/or guide a movement of the counter-bearing portions of the touring shoe. Preferably, the release path 400 extends substantially in parallel with a glide board plane.

Furthermore, an entry path 404 can be defined on the bearing arrangement 304, which path is preferably defined by means of a recess 406 and along which a counter-bearing portion of the touring shoe can enter, for example slide into, the front unit 302 of the touring binding in order to be held on the front unit 302. The recess 406 is preferably formed in the insert 390, in particular in the protrusion 394. The entry path 404 preferably extends perpendicularly to the glide board plane when the front unit 302 is in an entry state.

In the following, the functioning in the fourth embodiment will be described in detail. In an entry state, one of the entry contours 388 is aligned with the recess 406 so that a counter-bearing portion of a touring shoe is guided through the recess 406 relative to the entry contour 388, whereby said portion enters the bearing element 362, preferably the through-opening 370, along the entry path 404.

The recess 406 is preferably vertical in the entry state, so that the entry path 404 extends substantially perpendicularly to the glide board plane when in the descent state. Likewise, when in an entry state, which preferably coincides with the descent state, the disengagement contour 386 is aligned with the release path 400, so that a Z-disengagement can occur in a particularly simple manner. In the descent state, the front unit is designed to hold a touring shoe and is thus in a holding configuration.

In the descent state and entry state, a leg 304*l* or 304*r* bears against a first sub-leg 312*l* or 312*r*, thereby preventing the bearing arrangement 304 from rotating in a direction R. At the same time, the carriage 330 strikes a stop protrusion 337 on the base element 308, the second support element 326 being deflected out of an orientation that is perpendicular to a displacement path of the carriage 330, in a direction towards the front support 336 or the stop protrusion 337. In addition, the axis 328 can form the contact element of the carriage 330 on the stop protrusion 337. Due to this deflection, the bearing arrangement 304 pivoting about the pivot 310 counter to direction R would lead to the carriage 330 moving forwards; however, this is prevented by the carriage 330 striking the stop protrusion 337, meaning that the bearing arrangement 304 is prevented from pivoting counter to direction R in the descent state and entry state too. When the support and carriage are in this position, the front unit is in a locked state, since movement from the holding configuration to a withdrawal configuration (yet to be described) is prevented.

Figure 20:
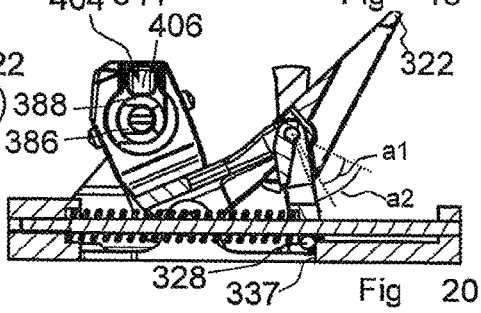
FIG. 20 is a sectional view, along a glide board central plane, of the front unit from FIG. 12 in an entry state, a descent state and a holding configuration.
Figure 22:
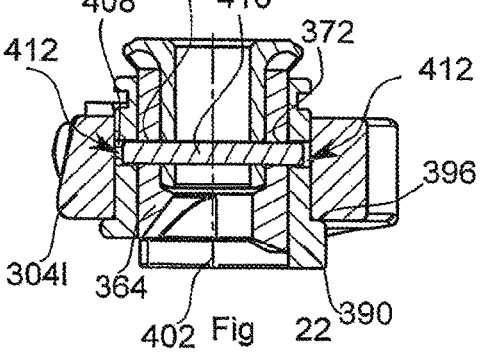
FIG. 22 is a sectional view along E-E from FIG. 21.
Figure 21:
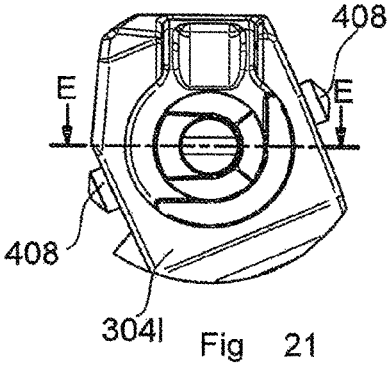
FIG. 21 shows a portion of the front unit from FIG. 12.
Figure 23:
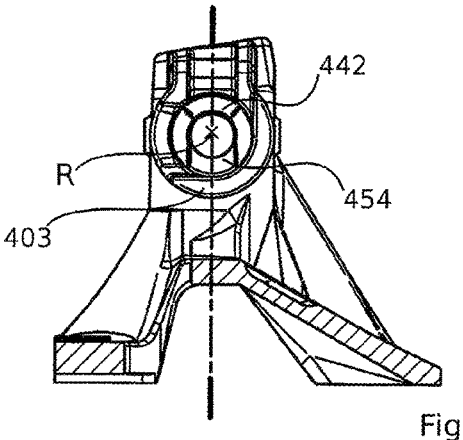
FIG. 23 is a sectional view of a front unit according to a fifth embodiment of the invention, using a vertical sectional plane extending in the longitudinal direction of the ski, the front unit being set in a walking position.
Figure 26:
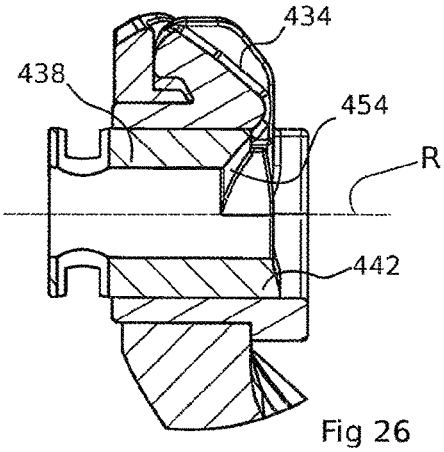
FIG. 26 is a sectional view of a bushing of the front unit from the fifth embodiment, including the axis of rotation R.

If the lever 322 is now pivoted from the descent state and entry state in FIG. 20 counter to direction W, the opening in the disengagement contour 386 is oriented towards the collar 402 by means of the flexible element 348, meaning that a counter-bearing portion of a touring shoe cannot exit the bearing element; this state can be considered to be part of the holding configuration. In particular, when the bushing 364 is in this position, the release path is blocked by the blocking portion 376 in such a way as to prevent the counter-bearing portion from exiting the bearing element, and the front unit 302 is in a blocked state. Furthermore, in the blocked state, the cover 378 not only prevents the counter-bearing portion from moving out of the bearing element along the entry path, but also in particular prevents the counter-bearing portion from entering the bearing element by blocking the entry path. In the blocked state and when climbing, the touring shoe can be pivoted on the front unit 302 about a transverse axis Q extending transversely to the glide board longitudinal axis. In the blocked state, the pivots 310, 324 and 328 are arranged in substantially the same way as they are in the descent state and entry state.

If the lever 322 is pivoted in direction W out of the blocked state of the front unit 302, the front unit 302 returns to the descent state and entry state.

If the lever 322 is pivoted in direction W out of the rest position up to the angle a1, the first stop element 342 engages on the second support element 326, and when the lever 322 is rotated further, the second support element 326 is pivoted counter to the force of the spring 340. This pivoting is made possible by the flexibility of the guide rod 334 and/or by the carriage 330 having sufficient play on the guide rod 334. If the lever 322 is pivoted out of the rest position thereof up to the angle a2, the second support element 326 is rotated/pivoted beyond a vertical orientation in relation to a displacement path of the carriage 330 so that the second support element 326 deviates from said vertical orientation—a dead centre position of the arrangement consisting of the second support element 326, the base portion 306 and the guided carriage 330—towards the rear support 338. From the moment the vertical orientation of the second support element 326 is passed towards the rear support, the base portion 306 can pivot counter to direction R, allowing movement from the holding configuration to a withdrawal configuration (yet to be described); after this moment, therefore, the front unit is in an unlocked state.

Since the second stop element 344 engages on the base portion 306 once the lever 322 reaches the angle a2, the base portion 306 is pivoted counter to direction R if further force is exerted in direction K, meaning that the bearing arrangement 304, together with the bearing element 362, moves in a direction of the glide board longitudinal axis, in particular forwards, as a result of which a touring shoe is removed from a heel unit (where provided) and the front unit is in a withdrawal configuration, since the touring shoe is not being prevented from being removed from the front unit 302 by a heel unit. Preferably, once the lever 322 reaches the angle a2, the first stop element 342 engages on the second support element 326 and the second stop element 344 engages on the base portion 306. When the lever 322 moves from the angle a1 to the angle a2, the bushing 364 can rotate slightly further in direction S, although the angle through which the bushing 364 pivots as a result is preferably relatively small and has accordingly not been shown in the drawings. In a preferred embodiment, the bushing 364 is prevented from rotating further with the lever 322 as it moves from the angle a1 to the angle a2 by the pin 410 striking an end of one of the cut-out grooves 412, in relation to the circumferential direction of the opening 392, preferably by the pin 410 striking an end of a first cut-out groove 412, in relation to a circumferential direction of the opening 392, and an end of a second cut-out groove 412, in relation to a circumferential direction of the opening 392. In particular, it is conceivable in this case for the flexible element 348 to be designed to stretch to such an extent that, even when the pin 410 strikes an end of the groove 412 and the bushing 364 is thus blocked from rotating further, as described above, the lever 322 can pivot further about the pivot 324 until the angle a2 is reached and the second stop element 344 can strike the base portion 306.

The lever 322 can be rotated further until the pivot 324 strikes the guide rod 334. In relation to the entry state and descent state, when the bushing 364 reaches this stop as a result of the movement of the lever 322, said bushing is not rotated or is rotated only slightly in direction S compared with the position thereof in the descent state and entry state, meaning that no element is blocking the disengagement contour and the user can release the touring shoe from the front unit 302 by slightly pivoting sideways; the front unit is in a withdrawal state, which can be considered to be a part of the withdrawal configuration. If no further force is applied to the lever 322, the spring 340 drives the carriage 330 forwards, upon which the front unit 302 moves into the entry state and descent state due to the first stop element 342 bearing against the second support element 326 and the second stop element 344 bearing against the base portion 306 (over respective angular regions; see above), the movement of the lever 322 being coupled to the movement of the bushing 364.

In the withdrawal state, the descent state and the entry state, the front unit 302 is in a neutral state since the release path is not blocked, and movement of a counter-bearing portion is permitted.

In principle, it is possible to provide engagement points on a bushing in one of the first three embodiments and to use said points instead of the bushing 364, the insert from the corresponding first, second or third embodiment preferably being used instead of the insert 390.

Fifth Embodiment

In the following, a fifth embodiment of the invention will be described with reference to FIGS. 23 to 26. This embodiment is also a variant on the first embodiment, and therefore only the differences from the first embodiment will be described in greater detail in the following, and explicit reference is made to the description of the first embodiment elsewhere.

A rotatable bushing 438 in the fifth embodiment is mounted so as to be rotatable about an axis of rotation R and comprises, on the end face thereof facing the shoe, a blocking portion 442 formed by a circumferential portion that protrudes in the axial direction R on the shoe side. The protruding circumferential portion can extend over more than 90°, preferably over more than 180°, in the circumferential direction of the bushing.

On a circumferential portion of the bushing 438 diametrically opposite the blocking portion 442, a release portion forming a disengagement contour 454 is formed. The disengagement contour 454 comprises a chamfer (release chamfer) that faces the axis of rotation R and extends obliquely with respect to the axis of rotation at an angle of between approximately 30° and approximately 60°. Said release chamfer is therefore designed to repel a pin received in the bushing 438 and guide said pin out of the bushing 438 when the binding is disengaged.

The bearing arrangement of the front unit in the fifth embodiment further comprises an entry chamfer 434 that leads towards the bushing 438 and forms an entry contour. The entry chamfer 434 extends obliquely with respect to the axis of rotation R at an angle of between approximately 30° and approximately 60° and faces away from the axis of rotation. When stepping into the binding, a pin provided on the shoe can be guided along the entry chamfer 434 into the interior of the bushing 438.

Figure 24:
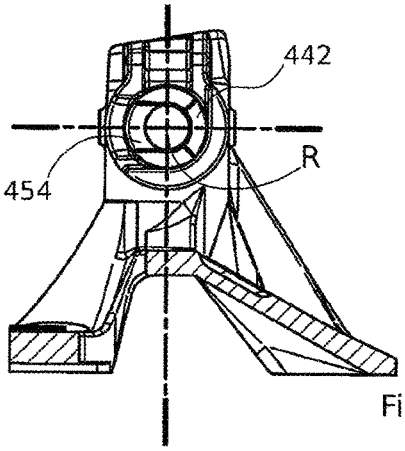
FIG. 24 is a view similar to FIG. 23, but showing an entry and descent position of the front unit.

To step into the binding, the front unit in the fifth embodiment can be placed in the position shown in FIG. 24 by the bushing 438 being brought into such a rotational position that the disengagement contour 454 is oriented in the horizontal direction, in particular pointing backwards. To step in, the ski shoe is brought down from above so that the pins of the ski shoe slide down on the entry chamfer 434 and enter the bushing 438. For this purpose, the pins are advantageously mounted on the shoe in an axially movable manner and are pretensioned outwards by means of a spring. The front unit is then immediately in a descent position, in which the pin of the ski shoe is normally held in the bushing 438 but can exit the bushing 438 horizontally via the disengagement contour 454 if a predetermined disengagement force is exceeded. However, the pin is reliably prevented from slipping out of the bushing 438 in the vertical direction (or forwards in the embodiment). Upon disengagement, the pin again slides down on the chamfer of the disengagement contour 454. A disengagement value is thus influenced by both the pretensioning of the pins and the gradient of the chamfer of the disengagement contour 454.

To transfer the front unit into the walking position, the bushing 438 can be rotated through 90° until the blocking portion 442 points upwards and the disengagement contour 454 points downwards. A collar 403 of the bearing element, which collar is adjacent to the disengagement contour 454 when in this position, prevents the pin from slipping out vertically downwards when the front unit is in this walking position. On the other hand, it is prevented from slipping out upwards or horizontally by the blocking portion 442, which extends over more than 180° in the circumferential direction. In this position, the front unit is completely blocked and does not allow the pin to exit the bushing 438.

Figure 25:
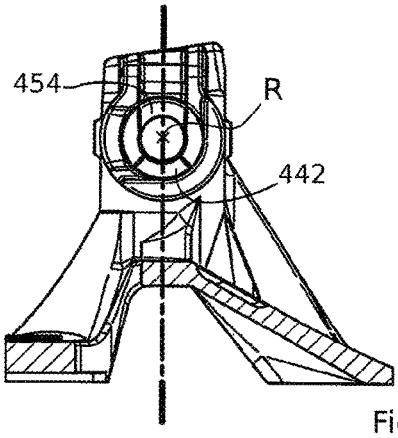
FIG. 25 is a view similar to FIG. 23, but showing a withdrawal position of the front unit.

If the bushing 448 rotates further by 180° out of the walking position or by 90° out of the entry and descent position (FIG. 24), the front unit moves into a withdrawal position (shown in FIG. 25). When in the withdrawal position, the disengagement contour 454 points vertically upwards. By means of the chamfer of the disengagement contour 454, the pin can now exit the bushing 438 in order to release the shoe from the binding for withdrawal. In the fifth embodiment, the disengagement contour 454 thus has a dual function: firstly, to allow disengagement for safety reasons, and secondly, for withdrawal from the binding.

Instead of the bushing 448 rotating through 90°, in a variant in the fifth embodiment, the front unit can also move between the entry and descent position, walking position and withdrawal position by the bushing 448 rotating through an angle $$\alpha=\beta+n*90°$$

where $80° \leq \beta \leq 100°$, preferably $\beta=90°$, and $n \geq 0$ is a natural number. Rotations through angles of approximately 90°, approximately 180°, etc. are particularly intuitive for users and easy for them to learn.

The invention further provides the following subject matter:

Subject matter 1: Front unit (302) of a touring binding, preferably according to any of the accompanying claims 1 to 7.

Subject matter 2: Front unit (302), wherein the front unit (302) comprises a bearing arrangement (304) having a bearing element (362), wherein the bearing element (362) is designed to hold a touring shoe on the front unit (302) on a counter-bearing portion of the touring shoe so as to be pivotable about a transverse axis (Q) extending transversely to a glide board longitudinal axis, and wherein the front unit (302) has a holding configuration and a withdrawal configuration, wherein the bearing arrangement (304) performs a forward movement when the front unit (302) moves from a holding configuration to a withdrawal configuration.

Subject matter 3: Front unit (302) according to subject matter 2, wherein the bearing arrangement (304) performs a pivoting movement, preferably about a pivot axis extending transversely to the glide board longitudinal axis, when the front unit (302) moves between the holding configuration and the withdrawal configuration.

Subject matter 4: Front unit (302) according to either subject matter 2 or subject matter 3, further comprising a locking arrangement designed to prevent movement from the holding configuration into the withdrawal configuration when in a locked state, and to allow movement from the holding configuration into the withdrawal configuration when in an unlocked state.

Subject matter 5: Front unit (302) according to subject matter 4, wherein the locking arrangement comprises: a carriage guide (332), preferably having a carriage stop (337), and a carriage (330), a first support element (306), a second support element (326), a first pivot (310), a second pivot (324), a third pivot (328), and a lever (322) having a first stop element (342) and a second stop element (344);

wherein the first, second and third pivots preferably extend in parallel with one another, wherein the first pivot (310) is arranged immovably in relation to the carriage guide (332) and the third pivot (328) is arranged immovably in relation to the carriage (330), wherein the first support element (306) interconnects the first (310) and second (324) pivots and mounts said pivots in a pivotal manner, and the second support element (326) interconnects the second (324) and third (328) pivots and mounts said pivots in a pivotal manner, wherein the lever (322) is mounted pivotally on the second pivot (324), wherein the first stop element (342) engages on the second support element (326) when the lever (322) pivots out of a rest position in a first direction through a first angle (a1), wherein the second stop element (344) engages on the first support element (306) when the lever pivots out of the rest position in the first direction through a second angle (a2) that is greater than the first angle (a1).

Subject matter 5: Front unit (2; 302) of a touring binding, preferably according to any of the preceding subjects, the front unit (2; 302) comprising a bearing arrangement (4; 304) having a bearing element (6, 10; 362), the bearing element (6, 10; 362) being designed to hold a touring shoe on the front unit (2; 302) on a counter-bearing portion of the touring shoe so as to be pivotable about a transverse axis (Q) extending transversely to a glide board longitudinal axis, characterised in that the front unit (2; 302) is moved between a holding configuration and a withdrawal configuration of the front unit (2; 302), or in that the front unit (2; 302) is moved between a neutral state and a blocked state of the front unit (2; 302), by a tensile force being transmitted by means of at least one flexible element (58, 348), preferably a cord, a chain, a flexible strap or a flexible bar.

Subject matter 6: Front unit (2; 302) according to subject matter 5, wherein the front unit (2; 302) is moved between two states selected from a release state, an entry state and a withdrawal state of the front unit (2; 302) by a tensile force being transmitted by means of the flexible element (58; 348).

Subject matter 7: Front unit (2; 302) according to either subject matter 5 or subject matter 6, further comprising: a pivotable lever (22; 322), a first engagement portion (60; 346) designed for rotation together with the lever (22; 322) and a second engagement portion (56; 366*o*, 366*u*) designed for rotation together with the bearing element (6, 10; 362), wherein the first engagement portion (60; 346) is connected to the second engagement portion (56; 366*o*, 366*u*) for conjoint rotation by means of the flexible element (58; 348), and wherein the flexible element (58; 348) pivots the lever into the rotational movement of the bearing element (6, 10; 362) by transmitting a tensile force.

The invention claimed is:

1. Front unit of a touring binding, comprising:

a bearing arrangement having a bearing element, the bearing element being designed to hold a touring shoe on the front unit on a counter-bearing portion of the touring shoe so as to be pivotable about a transverse axis extending transversely to a glide board longitudinal axis;

a release path being defined on the bearing arrangement, along which path the counter-bearing portion of the touring shoe is configured to exit the bearing arrangement;

a blocking portion designed to:

block a movement of the counter-bearing portion of the touring shoe along the release path when the front unit is in a blocked state; and allow the movement of the counter-bearing portion of the touring shoe along the release path when the front unit is in a neutral state, wherein, when moving from the neutral state into the blocked state, the blocking portion performs a rotational movement about an axis of rotation of the blocking portion, which axis extends transversely to a glide board longitudinal axis.

2. Front unit of a touring binding according to claim 1, wherein the blocking portion is formed on the bearing element, and the bearing element, when moving from the neutral state into the blocked state, performs a rotational movement about an axis of rotation of the bearing element, which axis extends transversely to a glide board longitudinal axis.

3. Front unit according to claim 2, wherein the bearing element is formed as a bushing rotatable about the axis of rotation, the blocking portion forming a circumferential portion of the bushing that protrudes in an axial direction on a shoe side.

4. Front unit according to claim 3, wherein a release portion associated with the release path is formed by a circumferential portion of the bushing that is axially set back in relation to the blocking portion.

5. Front unit according to claim 3, wherein a release portion associated with the release path has a release chamfer that extends obliquely with respect to the axis of rotation at an angle of between approximately 10° and approximately 80° to the axis of rotation, faces the axis of rotation and forms a disengagement contour or a withdrawal contour.

6. Front unit according to claim 3, wherein the bearing arrangement comprises an entry chamfer that leads to the bushing or is formed on the bushing and forms an entry contour, the entry chamfer extending obliquely with respect to the axis of rotation at an angle of between approximately 10° and approximately 80° to the axis of rotation, and facing away from the axis of rotation.

7. Front unit according to claim 6, wherein the blocking portion, a release chamfer and the entry chamfer are formed on the bushing on three circumferential portions of the bushing that are offset from one another in a circumferential direction.

8. Front unit according to claim 1, wherein when moving between the neutral state and the blocked state, the blocking portion performs a rotational movement through an angle $$\alpha=\beta+n*90°$$

where $80° \leq \beta \leq 100°$, and $n \geq 0$ is a natural number.

9. Front unit according to claim 1, wherein, when moving between the neutral state and the blocked state, the blocking portion performs a rotational movement through an angle $$\alpha=\beta+n*90°$$

where $20° \leq \beta \leq 70°$ and $n \geq 0$ is a natural number.

10. Front unit of a touring binding according to claim 1, wherein the blocking portion extends substantially in a direction along the axis of rotation of the bearing element.

11. Front unit of a touring binding according to claim 1, wherein the front unit is designed to assume at least one of an entry state, a descent state, and a withdrawal state; wherein, when moving between the blocked state and at least one of the neutral state, entry state, descent state, and withdrawal state, the bearing element performs a rotational movement about an axis of rotation of the bearing element, which axis extends transversely to a glide board longitudinal axis.

12. Front unit of a touring binding according to claim 1, wherein the release path extends substantially in parallel with a glide board longitudinal axis.

13. Front unit of a touring binding according to claim 1, wherein the bearing element is designed to receive the counter-bearing portion of the touring shoe.

14. Front unit of a touring binding according to claim 1, wherein an entry path is defined on the bearing arrangement and is designed to guide the counter-bearing portion of the touring shoe into the bearing element, wherein the entry path extends substantially perpendicularly to a glide board plane when the front unit is in an entry state.

15. A system comprising a front unit of a touring binding according to claim 1 and a touring shoe, wherein the touring shoe comprises two counter-bearing portions that protrude sideways from a front portion of a sole of the touring shoe and of which at least one is designed to be held on the front unit, on the bearing element of the front unit, so as to be pivotable about the transverse axis extending transversely to the glide board longitudinal axis, wherein a position of the two counter-bearing portions relative to one another and relative to the sole of the touring shoe is fixed.

16. A system according to claim 15, wherein the two counter-bearing portions comprise protrusions or pins, and wherein a position of the protrusions or the pins relative to one another and relative to the sole of the touring shoe is fixed.

17. A system according to claim 15, wherein the two counter-bearing portions protrude laterally in opposite directions from a front side of the touring shoe.

18. Front unit of a touring binding according to claim 1, wherein the front unit further comprises at least one of an entry contour, a disengagement contour, and a withdrawal contour that is formed on the bearing element, and wherein at least one of the entry contour, the disengagement contour, and the withdrawal contour is formed as a recess substantially in one direction along the axis of rotation of the bearing element.

19. Front unit of a touring binding according to claim 1, wherein the front unit is designed to assume a descent state and a withdrawal state, wherein, when moving between the descent state and the withdrawal state, the bearing element performs a rotational movement about an axis of rotation of the bearing element, and wherein the axis of rotation extends transversely to a glide board longitudinal axis.

20. Front unit of a touring binding according to claim 1, wherein the counter-bearing portion-protrudes from a front portion of the touring shoe.

* * * * *